US005715898A

United States Patent [19]

Anderson

[11] Patent Number: 5,715,898

[45] Date of Patent: Feb. 10, 1998

[54] STABILISER FOR A DOWNHOLE APPARATUS

[76] Inventor: Charles Abernethy Anderson, Sunnyside Farmhouse, Banchory Devenick, Aberdeen, AB1 5YD, United Kingdom

[21] Appl. No.: 632,407

[22] PCT Filed: Oct. 21, 1994

[86] PCT No.: PCT/GB94/02312

§ 371 Date: May 6, 1996

§ 102(e) Date: May 6, 1996

[87] PCT Pub. No.: WO95/11368

PCT Pub. Date: Apr. 27, 1995

[30] Foreign Application Priority Data

Oct. 21, 1993 [GB] United Kingdom ..... 9321695

[51] Int. Cl.[6] ..... E21B 17/10

[52] U.S. Cl. ..... 175/325.3; 175/323

[58] Field of Search ..... 175/76, 325.3, 175/325.4, 323; 166/241.3

[56] References Cited

U.S. PATENT DOCUMENTS

| | | | |
|---|---|---|---|
| 1,517,027 | 11/1924 | Smith | 166/241.3 |
| 4,372,622 | 2/1983 | Cheek | 175/325.3 |
| 4,440,241 | 4/1984 | Anders | 175/61 |
| 4,548,284 | 10/1985 | Shinn et al. | 175/325.4 X |
| 5,522,467 | 6/1996 | Stevens et al. | 175/325.3 X |

FOREIGN PATENT DOCUMENTS

| | | | |
|---|---|---|---|
| 0 333 450 | 9/1989 | European Pat. Off. . | |
| 1810474 | 4/1993 | U.S.S.R. | 175/325.3 |
| 94/23174 | 10/1994 | WIPO . | |

*Primary Examiner*—David J. Bagnell

*Attorney, Agent, or Firm*—Bell Seltzer Intellectual Property Law Group; Alston & Bird LLP

[57] ABSTRACT

A downhole apparatus, such as a stabilizer, having rotary bearing members in the form of bearing balls (36) which are each mounted for omni-directional movement within a bearing assembly (20) mounted on the body (12) of the apparatus. Each bearing assembly (20) comprises a housing (22) containing a plurality of circulating balls (20) confined to the interior of the housing and forming a supporting bed for the bearing ball (36).

12 Claims, 2 Drawing Sheets

STABILISER FOR A DOWNHOLE APPARATUS

FIELD OF THE INVENTION

This invention relates to downhole apparatus for use in drill strings as employed in the drilling of oil and gas wells, and in particular to apparatus for facilitating both rotational movement of a drill string in the well bore and running the drill string into or out of the well.

BACKGROUND OF THE INVENTION

Downhole stabilisers are tools which are coupled into a drill string to bear against the wall of the drilled bore, or the casing lining the bore, and thus centralise the drill string in the bore. One known form of downhole stabiliser is described in EP-A-0333450 and comprises a generally cylindrical body having a throughbore and presenting a number of bearing balls projecting from pockets formed in the stabiliser for engagement with the wall of the well bore. The bearing balls are carried in individual bearing elements. The pockets in which the bearing elements and balls are mounted are cylindrical and are formed at the radially outer periphery of radially extending blades formed on the body. The blades extend along the axial length of the body and have gaps between adjacent blades allowing passage of fluid past the exterior of the body.

Other arrangements for reducing friction between a drill string and a bore well are described in GB-A-271839, U.S. Pat. Nos. 1,699,087, 1,801,294, 1,517,027, 3,907,048 and 4,372,622.

Stabilisers of this general form have been known and used for a number of years, however manufacturers have had difficulties in producing such a stabiliser with bearing elements which will provide satisfactory omni-directional movement, that is to facilitate movement of the drill string as it is rotated in the well bore and also to facilitate running of the string through the bore, while possessing the desired robustness and reliability.

SUMMARY OF THE INVENTION

The present invention provides a downhole apparatus having rotary bearing members in the form of bearing balls which are each mounted for omni-directional movement in a bearing assembly mounted on the body of the apparatus, each bearing assembly comprising a housing containing a plurality of recirculating balls confined to the interior of the housing and forming a supporting bed for the bearing ball.

By virtue of the bearing assembly each bearing ball is completely omni-directionally movable and is therefore in rotatable engagement with the wall of the well bore when the apparatus is functioning as, for example, a stabiliser in rotational movement or is being run into or out of the well. Thus, the apparatus may be provided in the form of a stabiliser or incorporated in any other downhole tool in which it is desired to reduce torque or drag created by contact with the bore wall such as, for example, a downhole mud motor.

Preferably, each bearing assembly housing contains a load-bearing table which defines a seat for the bearing ball, the recirculating balls forming an inter-layer between the bearing ball and the load-bearing table.

Preferably also, each housing incorporates a retaining cap which retains the bearing ball and includes an annular seal element in engagement with the bearing ball.

Preferably also, each load bearing table defines a concave surface, for the recirculating balls to be directed and circulated around the respective main ball, and a convex surface over which the recirculating balls circulate, the housing defining a corresponding opposing concave surface.

Preferably also, each bearing assembly is removably mounted on a pocket in the body of the apparatus, permitting removal of the assembly to facilitate, for example, replacement of worn or damaged bearing balls. The housing of each bearing assembly may include means for engaging a retaining member. Conveniently, the retaining member is releaseable from the exterior of the body. In a preferred embodiment each bearing assembly housing includes a retaining groove for engagement with one or more retaining bolts.

Preferably also, each bearing assembly housing includes means for forming a seal between the housing and the body pocket wall, to prevent ingress of drilling mud and the like therebetween; the presence of fine mud particles between the housing and pocket wall may lead to difficulties when an attempt is made to remove the housing from the body.

Preferably also, each bearing assembly housing includes a fill hole, which may be utilised to fill the housing of a completed assembly with lubricating oil.

Preferably also, a fluid conduit extends from the exterior of the body to each body pocket below the seal means. Fluid pressure may thus be utilised to push a bearing assembly from a respective pocket during disassembly of the apparatus.

When the apparatus is provided in the form of a stabiliser, it is preferred that the stabiliser has three radially protruding blades of helical configuration, with a plurality of bearing members provided in each blade.

BRIEF DESCRIPTION OF THE DRAWINGS

This and other aspects of the present invention will now be described, by way of example, with reference to the accompanying drawings, in which.

DETAILED DESCRIPTION OF DRAWINGS

Figure 1:
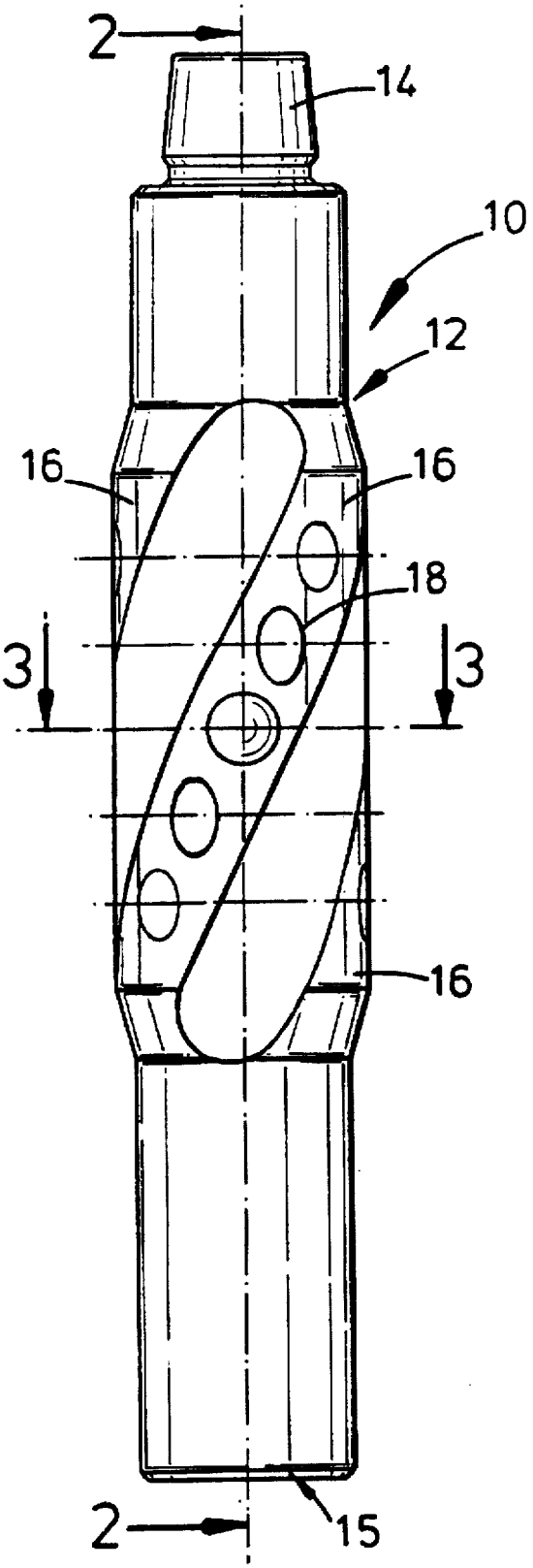
FIG. 1 is a view of a stabiliser in accordance with a preferred embodiment of the present invention.
Figure 2:
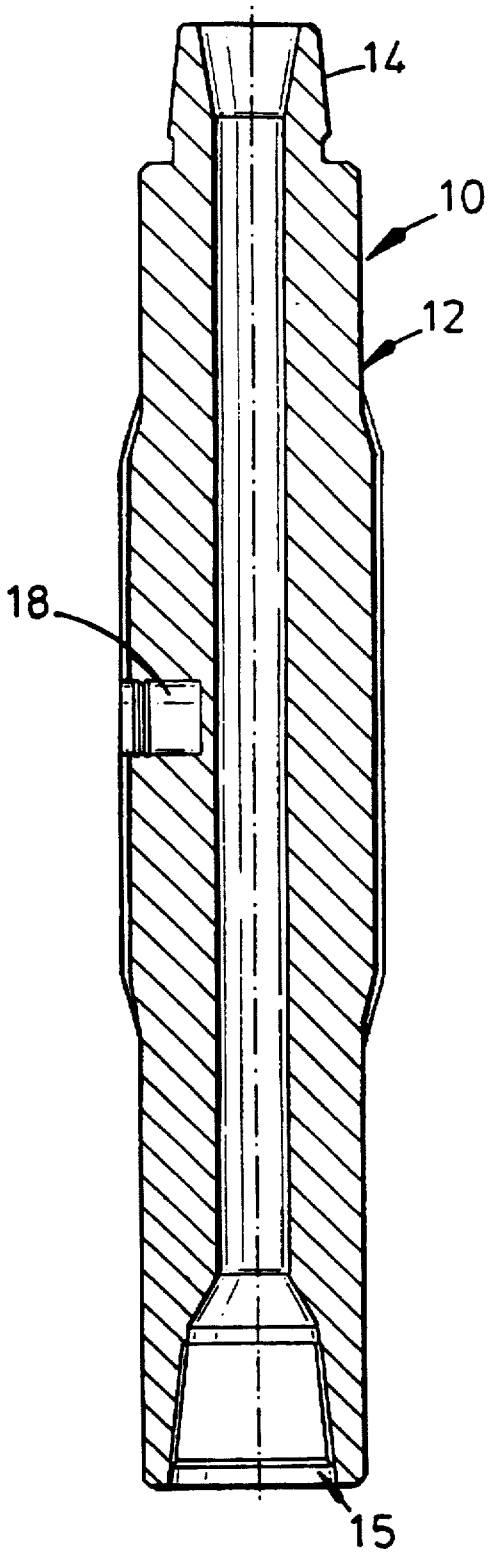
FIG. 2 is a sectional view on line 2—2 of FIG. 1.
Figure 3:
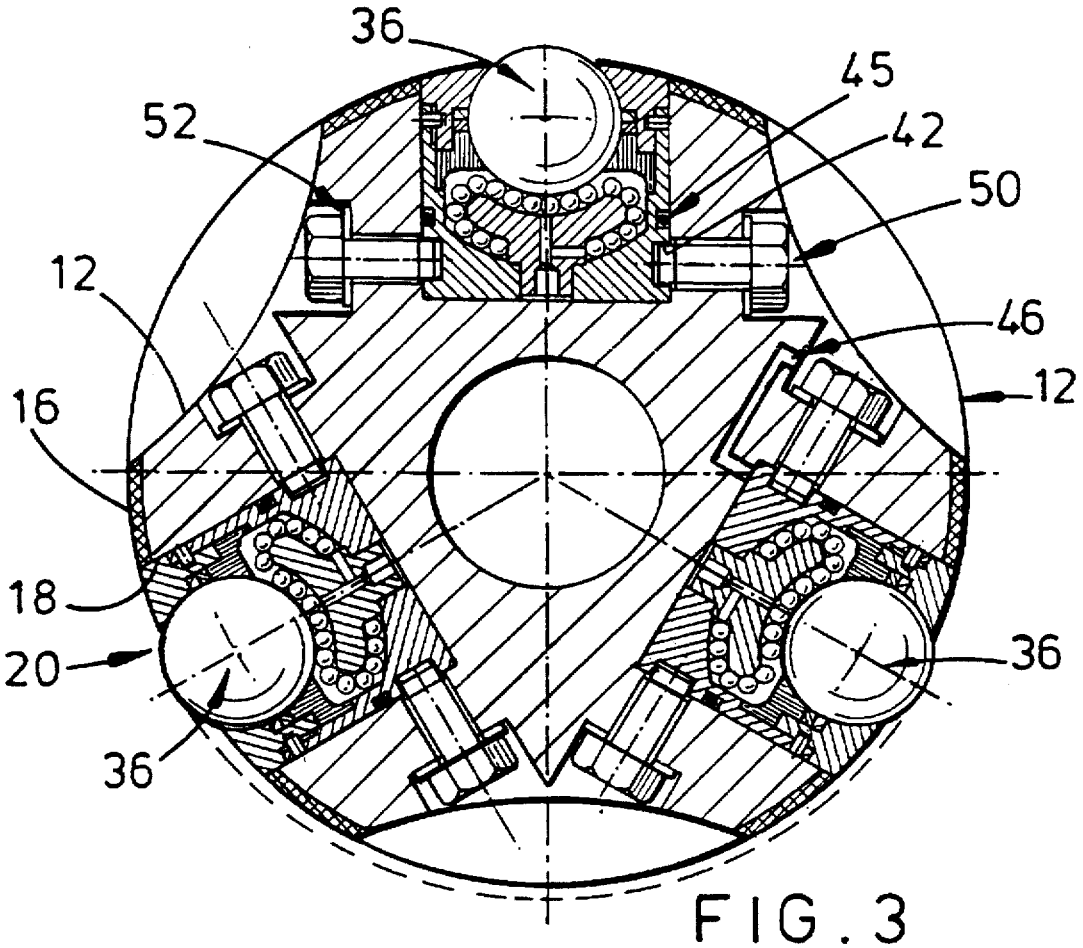
FIG. 3 is a sectional view on line 3—3 of FIG. 1, shown somewhat enlarged.
Figure 4:
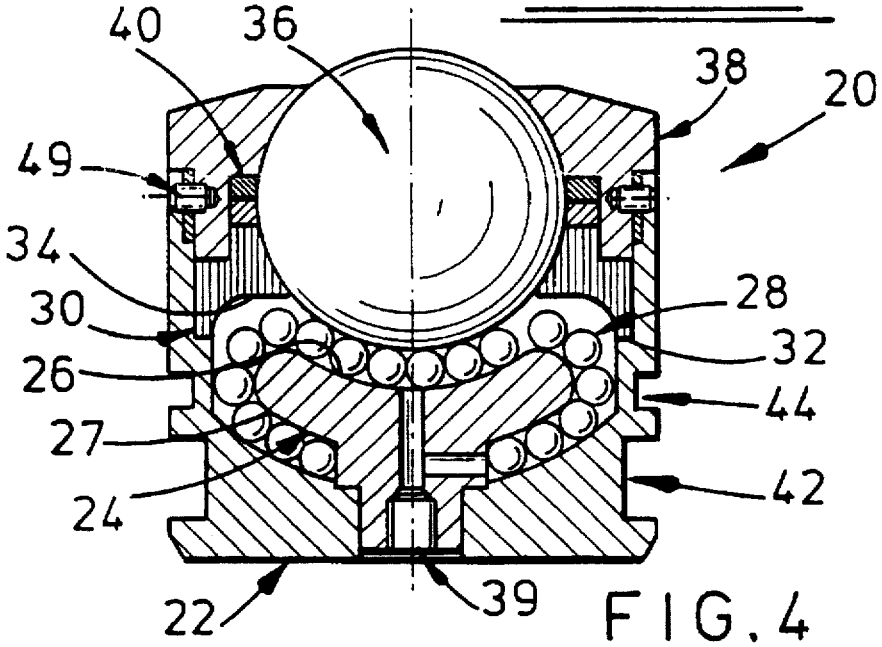
FIG. 4 is a half sectional view of a bearing assembly of the stabiliser of FIG. 1, shown somewhat enlarged.

Reference is first made to FIGS. 1, 2 and 3 of the drawings, which illustrate a stabiliser 10 in accordance with a preferred embodiment of the present invention. The hollow stabiliser body 12 is provided with conventional end connections 14, 15 to allow the stabiliser to form part of a drill string and defines three fins or blades 16 arranged in a helical configuration. Each of the blades 16 defines five axially spaced pockets 18, each of which accommodates a bearing assembly 20, as illustrated in FIG. 4 of the drawings, including a bearing ball 36.

Each assembly 20 comprises an outer housing or casing 22 adapted to fit snugly within a respective pocket 18. Mounted in the casing 22 is a load bearing table 24 defining smooth concave and convex surfaces 26, 27 for directing and circulating a plurality of recirculating balls 28. The balls are retained within the assembly by an inner ring or cap 30 which lands off against a shoulder 32 on the casing 22 thus providing a smooth concave surface 34 for the balls 28 to be directed and circulated around the table surfaces 26, 27 and the main ball 36, which sits on the recirculating balls 28 on the concave surface 26 of the table 24.

An oil fill hole 39 extends through the table 24, permitting a completed assembly 20 to be filled with lubricating oil prior to fitting in the body 12.

The main ball 36 is retained by a further cap 38 which is held relative to the casing 22 by retaining screws 49 and accommodates a pair of seals 40 formed of a suitable material such as polyurethane or a fluorocarbon rubber, for example Viton (Trade Mark). The cap 38 is sized such that the ball 36 only protrudes a small distance from the upper surface of the cap 38, in this example the 38.1 mm (1.5") diameter ball 36 protruding by only 3.18 mm (0.125").

The assembly is held in a respective pocket 18 by means of a pair of retaining bolts 50, the ends of which engage an annular groove 42 formed around the lower end of the casing 22. The heads of the bolts are located in recesses between the blades 16, and thus are protected from contact with the bore wall. A tab washer 52 is provided on each bolt 50, the tabs on each washer being lifted into engagement with flats on the respective bolt after tightening. A further groove 44 is provided on the casing 22 and this accommodates an O-ring 45 to form a seal between the pocket wall and the assembly 20. The O-ring 45 prevents the fine particles carried by the drilling mud from gaining access to the lower portion of the pocket; the presence of such particles in the pocket would make it very difficult to remove the bearing assembly from the pocket. A tapped hole 46 extends from the exterior of the stabiliser body 12 into the base of each pocket 18 (only one hole shown). These features are intended to assist in removal of an assembly 20 from a pocket 18 by allowing the application of hydraulic pressure through the hole 46 to the interior of the pocket 18.

The illustrated example is intended for location in a 31.12 cm (12¼") diameter bore and for this application the stabiliser body 12 has an OD of 30.48 cm (12") and when the bearing assemblies are fitted into the stabiliser body 12 the OD across the balls 36 is 31.12 cm (12¼") to match the diameter of the bore being drilled by the bit, it being the intention that the stabiliser blades 16 should never come into contact with the well bore wall but only the point contact of the rolling balls 36.

In use, one or more stabilisers 10 form part of a drill string, to facilitate running of the string through the bore, and also to facilitate movement of the string as it is rotated in the well bore. As each ball 36 rotates, the respective supporting balls 28 are free to rotate and move across the table surface 26. The balls 28 then roll along the lower table surface 27 and back up onto the upper surface 26. The balls 28 are thus freely moveable in all directions, such that the main ball 36 is completely omni-directional.

It will be clear to those of skill in the art that the above described embodiment is merely exemplary of the present invention and that the illustrated bearing assemblies could be utilised in a wide range of downhole tools, to provide a means for torque or drag reduction.

I claim:

1. Downhole apparatus comprising a body and a plurality of rotary bearing members in the form of bearing balls, each bearing ball mounted for omni-directional movement in a bearing assembly mounted on the body of the apparatus, each bearing assembly comprising a housing containing a plurality of recirculating balls confined to the interior of the housing and forming a supporting bed for the bearing ball.

2. The apparatus of claim 1 wherein each bearing assembly housing contains a load-bearing table which defines a seat for the bearing ball, the recirculating balls forming an inter-layer between the bearing ball and load-bearing table.

3. The apparatus of claim 1 wherein each bearing assembly housing incorporates a retaining cap which retains the bearing ball and includes an annular seal element in engagement of the bearing ball.

4. The apparatus of claim 2 wherein each load-bearing table defines a concave surface, for the recirculating balls to be directed and circulated around a respective bearing ball, and a convex surface over which the recirculating balls circulate, the housing defining a corresponding opposing concave surface.

5. The apparatus of claim 1 wherein each bearing assembly is removably mounted in a pocket in the body of the apparatus.

6. The apparatus of claim 5 wherein the housing of each bearing assembly includes means for engaging a retaining member.

7. The apparatus of claim 6 wherein the retaining member is releasable from the exterior of the body.

8. The apparatus of claim 7 wherein each bearing assembly housing includes a retaining groove for engagement with one or more retaining bolts.

9. The apparatus of claim 7 wherein each bearing assembly housing includes means for forming a seal between the housing and the body pocket.

10. The apparatus of claim 9 wherein a fluid conduit extends from the exterior of the body to each body pocket below the respective seal means.

11. The apparatus of claim 1 wherein each bearing assembly housing includes an oil fill hole.

12. A downhole stabiliser comprising a body defining three radially protruding blades of helical configuration, each blade being provided with a plurality of rotary members in the form of bearing balls, each bearing ball mounted for omni-directional movement in a bearing assembly mounted on the body, each bearing assembly comprising a housing containing a plurality of recirculating balls confined to the interior of the housing and forming a supporting bed for the bearing ball.

* * * * *